US009644618B2

(12) United States Patent
Hirai

(10) Patent No.: US 9,644,618 B2
(45) Date of Patent: May 9, 2017

(54) PORTABLE WORKING MACHINE

(71) Applicant: HITACHI KOKI CO., LTD., Tokyo (JP)

(72) Inventor: Takahiro Hirai, Hitachinaka (JP)

(73) Assignee: HITACHI KOKI CO., LTD., Tokyo (JP)

( * ) Notice: Subject to any disclaimer, the term of this patent is extended or adjusted under 35 U.S.C. 154(b) by 310 days.

(21) Appl. No.: 13/949,496

(22) Filed: Jul. 24, 2013

(65) Prior Publication Data

US 2014/0037482 A1 Feb. 6, 2014

(30) Foreign Application Priority Data

Aug. 3, 2012 (JP) ..... 2012-173309

(51) Int. Cl.
*F04B 9/02* (2006.01)
*B27B 17/12* (2006.01)

(52) U.S. Cl.
CPC ..... *F04B 9/02* (2013.01); *B27B 17/12* (2013.01)

(58) Field of Classification Search
CPC ..... F04B 7/06; F02B 67/04
USPC ..... 184/6.14
See application file for complete search history.

(56) References Cited

U.S. PATENT DOCUMENTS 4,090,748 A * 5/1978 Sugimoto et al. ..... 384/291
5,593,297 A * 1/1997 Nakajima et al. ..... 418/88
6,024,548 A * 2/2000 Bushnell ..... 418/94
8,573,361 B2 * 11/2013 Wakabayashi et al. ..... 184/6.12
2010/0046869 A1 * 2/2010 Matsuyama ..... 384/288

FOREIGN PATENT DOCUMENTS

JP 5-26316 U 7/1993

* cited by examiner

*Primary Examiner* — William E Dondero
*Assistant Examiner* — Mark K Buse
(74) *Attorney, Agent, or Firm* — McDermott Will & Emery LLP

(57) ABSTRACT

A working machine has an oil groove communicating a pump chamber with a gear chamber, and a small amount of oil is delivered to the gear chamber when oil is discharged from the pump chamber. Thus, the oil adheres to the outer peripheral surface of a rotating pump shaft and is kept remaining between a pump case and the pump shaft. Therefore, the viscosity is increased and a pressure loss between the pump chamber and the gear chamber is increased. Accordingly, the airtightness can be maintained, and the stable and inexpensive oil pump mechanism requiring less man-hour can be realized without depending on the accuracy of a gap between the pump case and the pump shaft. Since oil is kept remaining on the outer peripheral surface of the pump shaft, it is possible to prevent the pump case from being worn out and to improve the durability of components.

7 Claims, 11 Drawing Sheets

PORTABLE WORKING MACHINE

CROSS-REFERENCE TO RELATED APPLICATION

The present application claims priority from Japanese Patent Application No. 2012-173309 filed on Aug. 3, 2012, the content of which is hereby incorporated by reference into this application.

TECHNICAL FIELD OF THE INVENTION

The present invention relates to a potable working machine such as a chain saw which carries out the work while sucking oil (lubricating oil) from an oil tank to supply the sucked oil to a movable member (saw chain) of a working tool, and particularly relates to a portable working machine having an improved oil pump mechanism.

BACKGROUND OF THE INVENTION

In an oil pump mechanism of a conventional portable working machine, a pump shaft housed in a pump case is biased by an elastic body, is prevented from coming off with a fixing pin or the like, and moves forward and backward axially to expand and compress a volume in a pump chamber, thereby sucking and discharging oil. In conjunction with the rotation of the pump shaft, the pump chamber alternately communicates with a suction passage or a discharge passage. A sloped portion is formed on an end face of the pump shaft on a fixing pin side. Oil is sucked into the pump chamber through the suction passage when the pump chamber is expanded, and is discharged from the pump chamber through the discharge passage when the pump chamber is compressed. In order to enhance airtightness between the pump chamber and a gear chamber and airtightness between the pump chamber and the discharge passage, the pump case is manufactured so as to increase the machining accuracy of a portion in which the pump shaft is housed, and the machining accuracy of the pump shaft is also increased to improve the overall airtightness, thereby achieving the stable pumping performance.

Depending on a type of an oil pump, a pump case and a pump shaft are molded from synthetic resin and are assembled and used as it is without mechanical machining. In such a case, when either of a suction port or a discharge port of the pump chamber is closed, a gap between the pump case and the pump shaft is larger than a gap between the pump case and the pump shaft manufactured by mechanical machining. Therefore, a certain measure for reducing the gap is necessary. In Japanese Examined Utility Model Application Publication No. 5-26316 (Patent Document 1), a pushing device which biases a pump shaft toward an axial direction of a closed passage relative to an opening portion of either one of a suction port and a discharge port is provided to improve the sealability of a closed portion, thereby improving the pumping performance.

SUMMARY OF THE INVENTION

A series of studies by the inventor have revealed that the above-mentioned conventional structure has following problems. That is, although the machining accuracy of the pump case and the pump shaft is enhanced to improve the airtightness, difference occurs in the size of the gap between the pump case and the pump shaft due to variations in mass production, which becomes a factor for the unstable pumping performance. Consequently, further enhancement of the machining accuracy becomes necessary, which leads to an increase in machining costs, with the result that it becomes difficult to offer inexpensive components. Also, if the gap between the pump case and the pump shaft is reduced to increase the airtightness, since it becomes difficult to keep lubricating oil remaining on the outer peripheral surface of the pump shaft which rotates at high speed, a hole in the pump case in which the pump shaft is housed is rather worn out, which becomes a factor for the degradation in pumping performance in a long-term use.

Also, in Patent Document 1, the pushing device is provided for the pump case and the pump shaft to improve the sealability of the closed portion. In this structure, however, the number of components is increased to increase the cost, and further, if the pump shaft is pushed in one direction in the state where the machining accuracy of the pump case in which the pump shaft is housed is low, the airtightness between the pump chamber and the gear chamber cannot be maintained, which may invite a further degradation in pumping performance. As another solution to the problems, airtightness can be improved by increasing the length of a fitting portion between the pump case and the pump shaft to enlarge a pressure loss between the pump chamber and the gear chamber. However, if this structure is employed, the size of components is increased, which becomes an obstacle to the compact design of the oil pump.

An object of the present invention is to provide a portable working machine with an oil pump having superior durability and capable of maintaining stable pumping performance for a long period.

Another object of the present invention is to provide a portable working machine with an oil pump that operates stably without greatly depending on manufacturing/machining accuracy.

Still another object of the present invention is to provide a portable working machine in which the performance and durability of an oil pump mechanism are improved while maintaining the compact size of the oil pump mechanism.

The effects obtained by typical embodiments of the invention disclosed in the present application will be briefly described below.

According to one feature of the present invention, a portable working machine is provided with an oil pump which supplies oil from an oil tank to a movable member of a working tool by a rotation motion of a drive shaft of a power source, the oil pump includes: a pump case having a pump chamber whose one end is closed and to which a suction passage and a discharge passage are connected and a gear chamber in which a gear which converts rotation motion of the drive shaft is housed; and a pump shaft which is housed in the pump case, is connected to the gear, and has a tip end rotating in the pump chamber, and an oil groove, which communicates the pump chamber with the gear chamber when the pump shaft arrives at a predetermined rotation position, is formed in the pump case. This oil groove is formed at a location in contact with the pump shaft, and a suction passage, a discharge passage, and the oil groove are opened and closed by the rotation of the pump shaft. Also, when oil is discharged from the pump chamber, a small amount of oil is delivered to the gear chamber, so that the oil adheres to the outer peripheral surface of the rotating pump shaft, and the oil is suitably kept remaining between the pump case and the pump shaft.

According to another feature of the present invention, the oil groove is formed in an inner wall in contact with the pump shaft in the pump case. The pump shaft swings axially while rotating so that the tip end of the pump shaft compresses or expands the pump chamber, and the oil groove is formed in parallel with an axial direction of the pump shaft. The oil groove is preferably formed at a location at which the oil groove does not communicate when the oil is sucked through the suction passage to the pump chamber and communicates only when the oil is discharged from the pump chamber to the discharge passage, and when the oil is discharged from the pump chamber, a part of the oil flows from the pump chamber to the gear chamber through the oil groove.

According to still another feature of the present invention, the oil groove communicating with the gear chamber communicates with the pump chamber via the discharge passage. The oil groove is preferably formed of a through-hole formed in a wall of the pump case. Also, the oil groove may be made by forming a cutout or a groove in the pump shaft. Furthermore, the oil groove may be formed of a through-hole extending from a tip end surface of the pump shaft, passing through an interior thereof, and reaching a side surface of the pump shaft.

As described above, according to the present invention, the oil groove, which communicates the pump chamber with the gear chamber when the pump shaft arrives at a predetermined rotation position, is provided in the pump case. Therefore, pumping performance is maintained and the amount of oil delivery can be certainly stabilized. Also, since oil can be kept remaining in along area along the axial direction of the outer peripheral surface of the pump shaft, the pump case can be prevented from being worn out by the pump shaft which rotates at high speed, and the durability of components can also be improved.

Furthermore, since the oil groove is formed at a position in contact with the pump shaft, and the suction passage, the discharge passage, and the oil groove are opened and closed by the rotation of the pump shaft, an oil pump mechanism that is compact, stable, inexpensive, and requires less man-hour can be provided without depending on the accuracy of the gap between the pump case and the pump shaft and the length of the fitting portion between the pump case and the pump shaft.

Moreover, since the oil groove is formed on the inner wall in contact with the pump shaft, a portable working machine having an oil pump mechanism in which liquid leakage is less likely to occur can be realized without depending on the accuracy of the gap between the pump case and the pump shaft.

Since the oil groove is formed in parallel with the axial direction of the pump shaft, the viscosity of a material between the pump chamber and the gear chamber is increased by adhering oil to the pump shaft, so that a pressure loss is increased and airtightness can be maintained.

Since the oil groove does not communicate when oil is sucked from the suction passage into the pump chamber but communicates only when oil is discharged from the pump chamber to the discharge passage, a pressure loss at the time of suction can be prevented and the degradation in pumping performance can be prevented.

Since the oil groove communicating with the gear chamber communicates with the pump chamber via the discharge passage, oil can be supplied to the oil groove in synchronization with discharge timing.

BRIEF DESCRIPTIONS OF THE DRAWINGS

Figure 11:
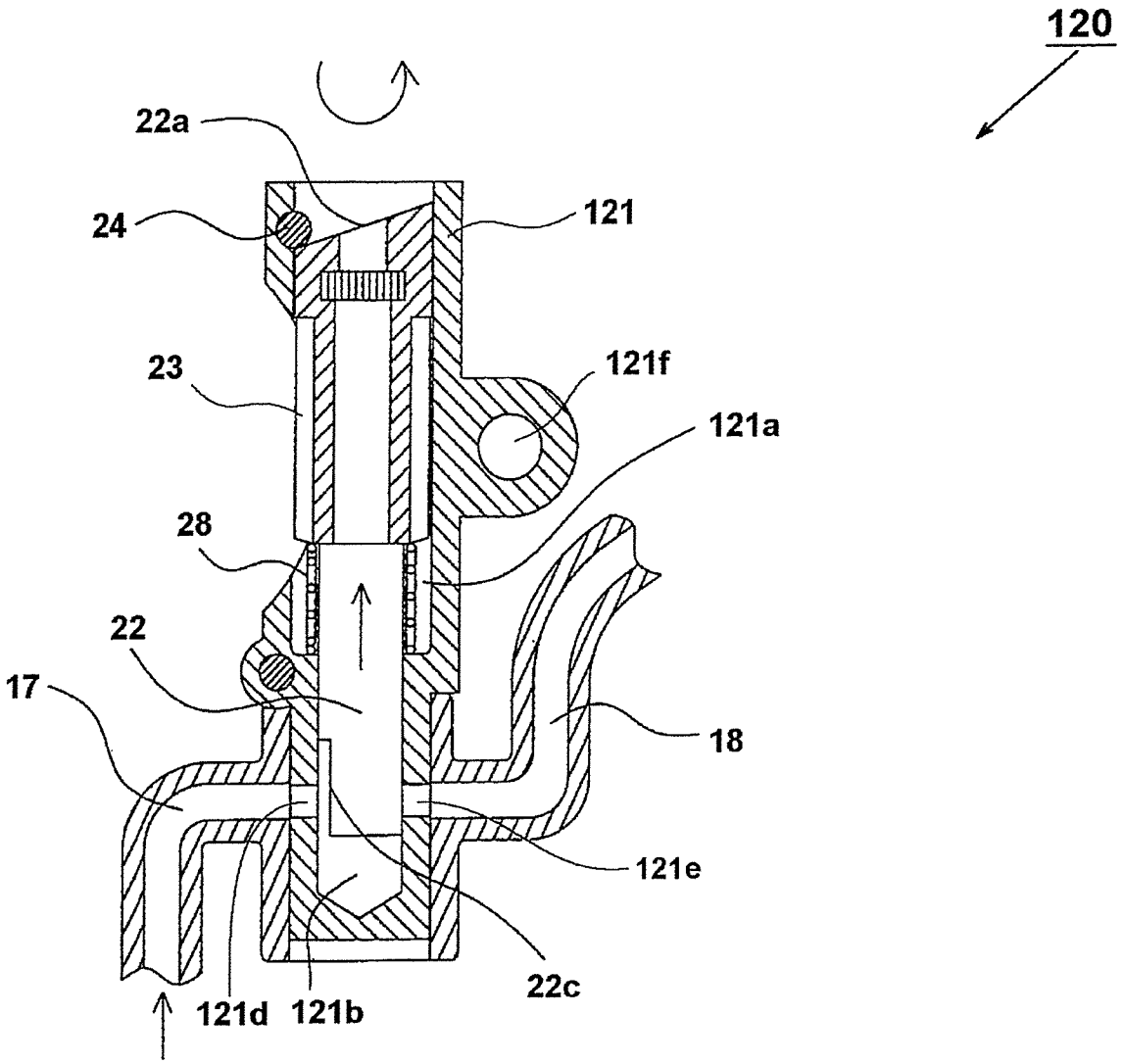
FIG. 11 Prior Art
Figure 12:
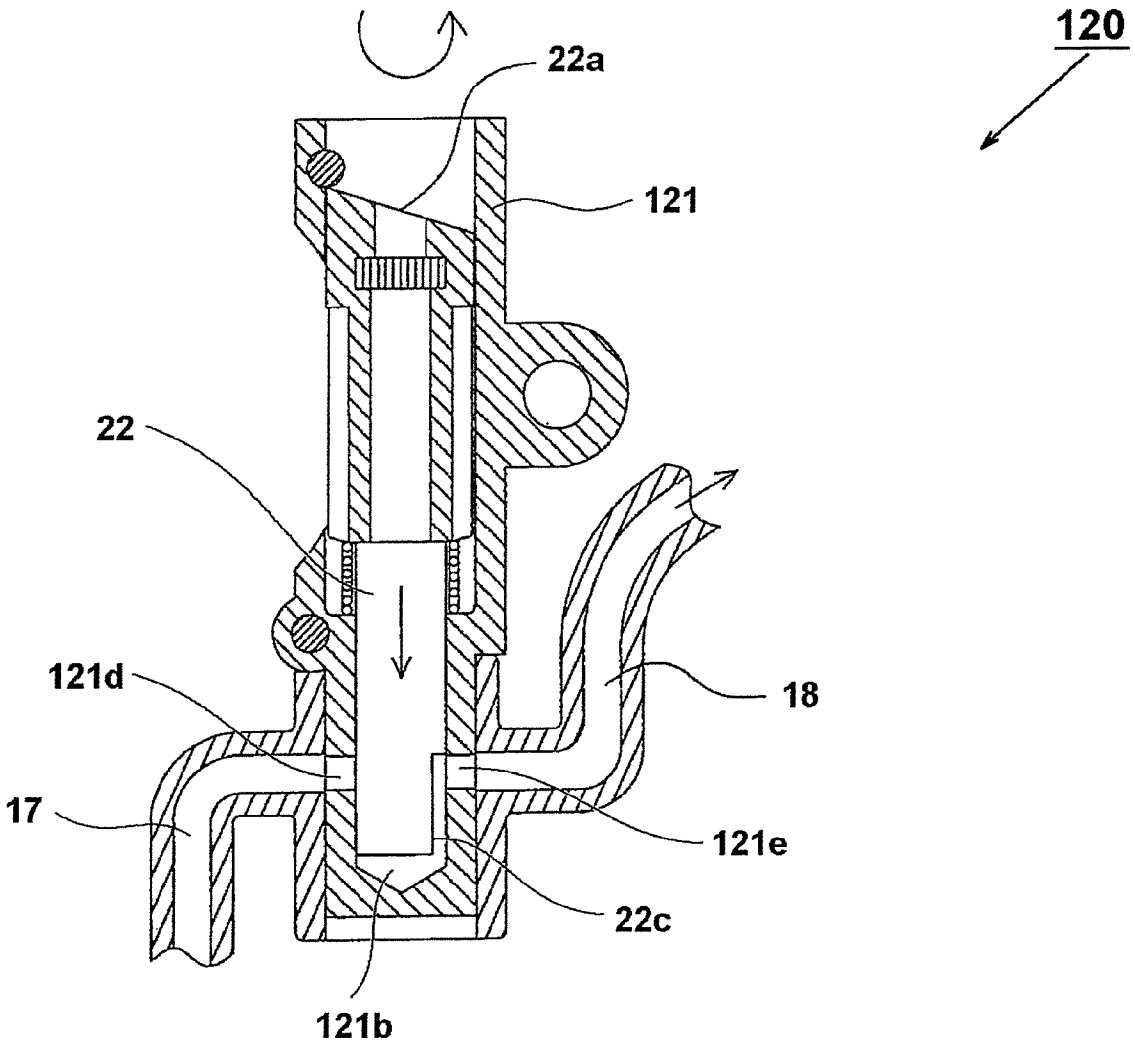
FIG. 12 Prior Art

FIG. 11 is a sectional view of a conventional oil pump 120, showing the oil pump 120 in a suction state; and FIG. 12 is a sectional view of the conventional oil pump 120, showing the oil pump 120 in a discharge state.

DESCRIPTIONS OF THE PREFERRED EMBODIMENTS

First Embodiment

Hereinafter, embodiments of the present invention will be described with reference to the accompanying drawings. Note that components having the same function are denoted by the same reference symbols in the following drawings, and the repetitive description thereof will be omitted.

Figure 1:
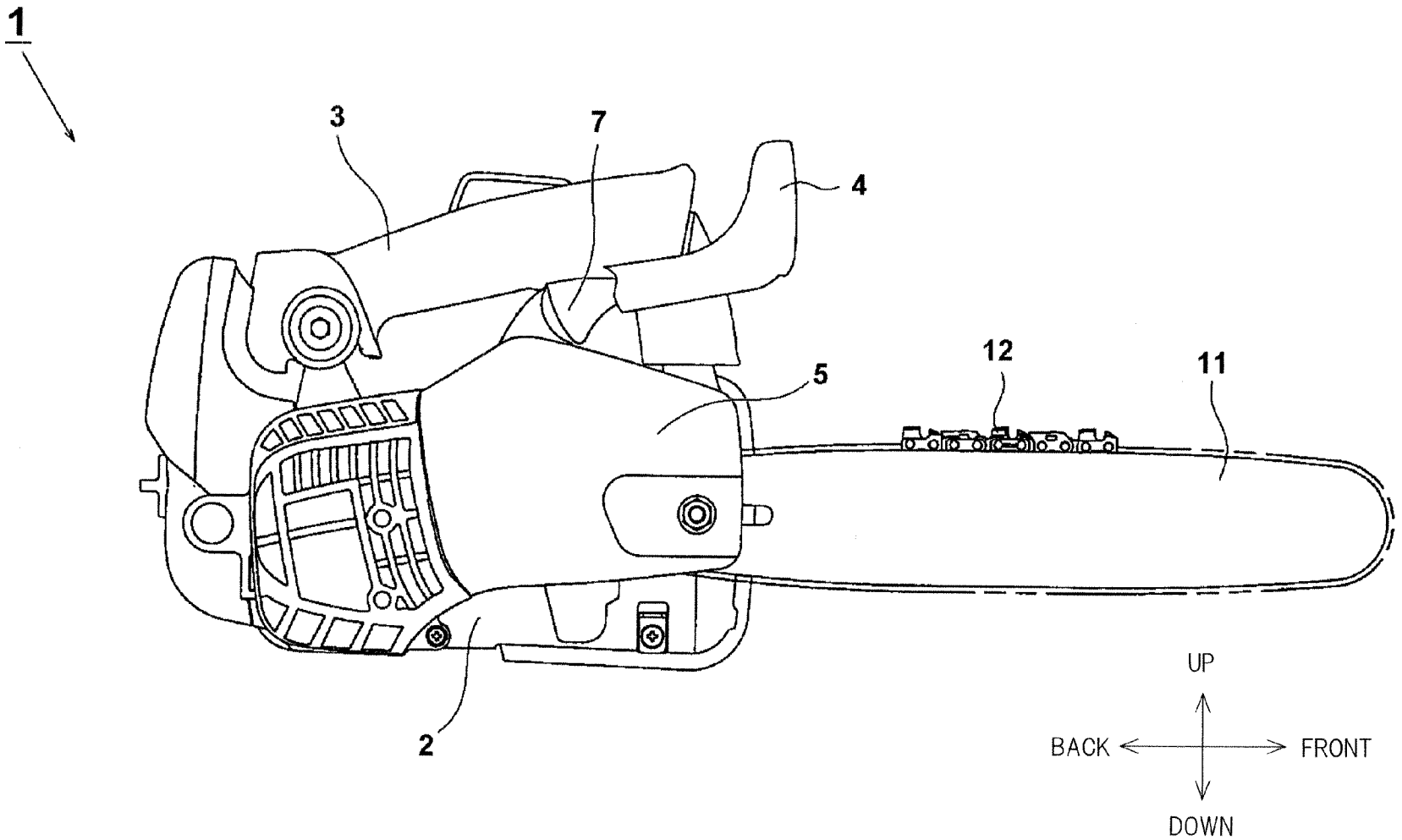
FIG. 1 is a right side view showing the outer appearance of a chain saw 1 according to an embodiment of the present invention.

In the description of this specification, forward, backward, upward, and downward directions are defined as those indicated in FIG. 1. In this embodiment, an engine-driven chain saw which carries out the work while supplying lubricating oil to a saw chain is described as an example of a portable working machine which requires oil supply.

FIG. 1 is a right side view showing the outer appearance of a chain saw 1 according to this embodiment. The chain saw 1 is driven by a driving source such as a small-sized 2-cycle or 4-cycle engine or a motor, and a guide bar 11 projects forward from the main body of the chain saw 1. A saw chain 12 is wound around an outer edge of the guide bar 11, and is rotated at high speed to cut wood, branches, and others. In this embodiment, a 2-cycle engine (not shown) is housed in a housing 2.

The housing 2 is a frame component of the chain saw 1, in which the engine is housed and to which the guide bar 11 and other covers are attached. A main handle 3 is disposed above the housing 2. In front of the main handle 3, a hand guard 4 is disposed. The hand guard 4 has a function to protect a hand of a worker from being hit by a branch, a cut piece and others and a function of a brake to stop the saw chain 12 from rotating when tilted forward.

The right side of the housing 2 (hereinafter, in the description of the specification, the forward, backward, upward, and downward directions are defined as those indicated in FIG. 1 based on the position of the worker who holds the chain saw 1, and the side on which the saw chain 12 is attached, that is, the right hand side of the worker is defined as the right side) is covered with a right cover 5, and a power transmitting mechanism that transmits a driving force from the engine to the saw chain 12 is attached in the right cover 5. The power transmitting mechanism includes a centrifugal clutch (not shown), and output power from the engine is transmitted from a drive shaft to the saw chain 12 through the centrifugal clutch.

The main handle 3 is the handle that the worker grasps with the right hand, and the worker carries out the work while grasping the main handle 3 with the right hand and a front handle (not shown) with the left hand. A throttle 7 for adjusting the number of revolutions of the engine is disposed under the main handle 3, and by pulling the throttle 7, the engine can be adjusted to any number of revolutions ranging from an idle state to a full-speed state. When the number of revolutions of the engine is increased from its idle state to a given number of revolutions, the saw chain 12 wound around the outer edge of the guide bar 11 starts rotating by the function of the centrifugal clutch (not shown), so that the chain saw 1 can cut trees and others.

Figure 2:
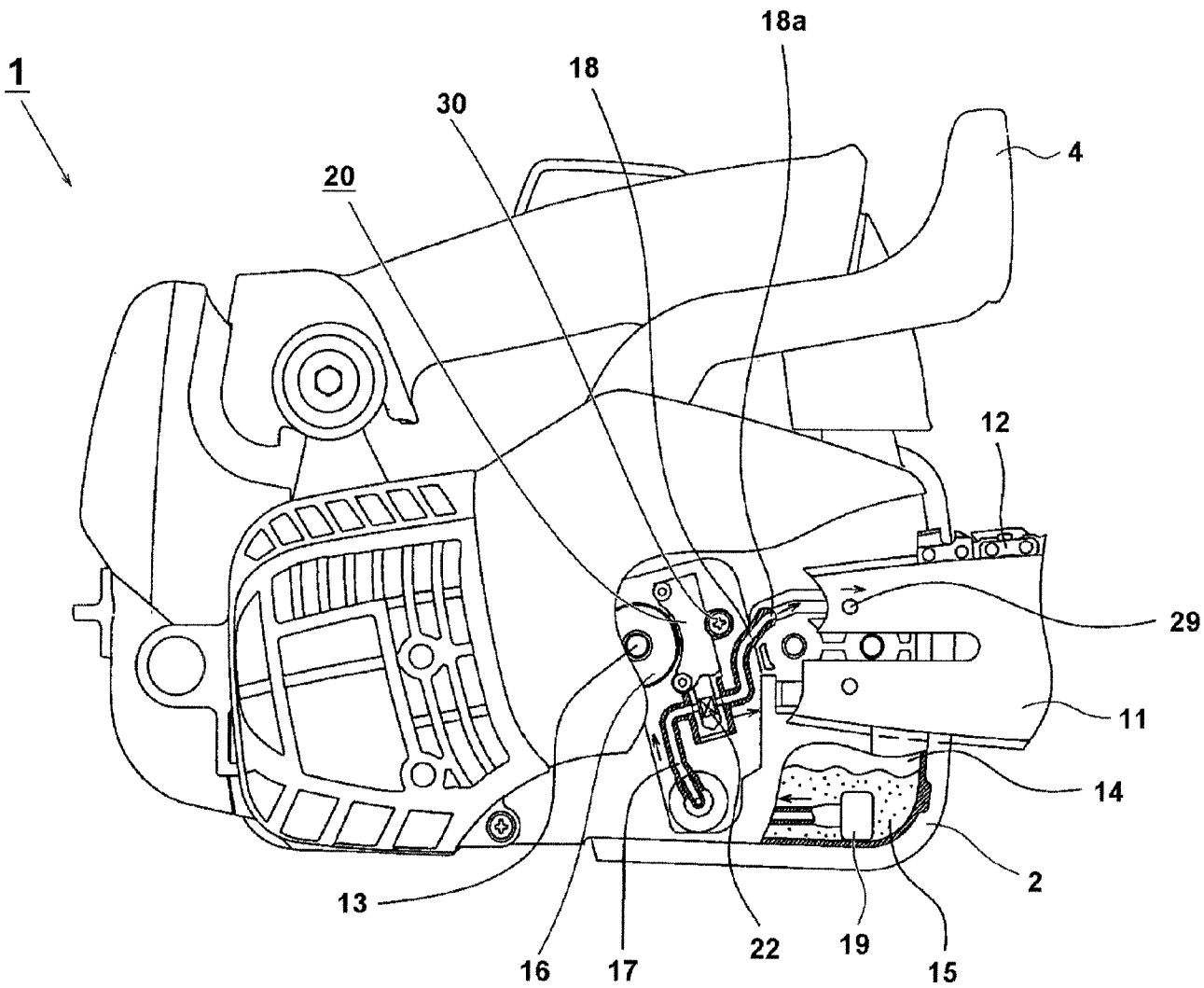
FIG. 2 is an enlarged sectional view of a part near an oil pump 20 of the chain saw 1 according to the embodiment of the present invention.

FIG. 2 is an enlarged sectional view of a part near an oil pump 20 of the chain saw 1 according to the embodiment of the present invention. In an internal space on the lower front side of the housing 2, an oil tank 14 is disposed. Oil 15 stored in the oil tank 14 is a lubricant supplied to movable parts of a working tool such as the saw chain 12, and the supplied oil 15 adheres to the saw chain 12 to help the guide bar 11 and the saw chain 12 smoothly work on a material to be cut, thereby preventing the burnout of the guide bar 11 and the saw chain 12. The oil is sucked by the oil pump 20 connected to a drive shaft 13 of the engine from the oil tank 14 through a suction passage 17, and the oil 15 discharged at a predetermined pressure by the oil pump 20 flows through a discharge passage 18 and is delivered from a discharge port 18*a*.

The oil pump 20 is liquid pumping means which converts the rotation motion of the drive shaft 13 of the engine into another rotation motion by using gear means and discharges the oil 15 through the discharge port 18*a* by a pump mechanism realized by the rotation of a pump shaft (not shown), and the oil pump 20 is attached to the housing 2 with a screw 30. The gear means is composed of a worm screw 16 disposed on the drive shaft 13 of the engine and a worm gear (described later) that is engaged with the worm screw 16 to rotate.

The mounting position of the oil pump 20 is not limited to that shown in FIG. 2, and the oil pump 20 can be mounted in any different position as long as the power from the drive shaft 13 can be transmitted and the oil can be suitably sucked from the oil tank 14. The oil 15 pumped out by the oil pump 20 is discharged from a discharge hole 29 formed in the guide bar 11, and adheres to the saw chain 12. The suction passage 17 connected to the suction port of the oil pump 20 is disposed so as to extend to the interior of the oil tank 14, and a filter 19 which filters dusts from the oil 15 is attached to the front end of the suction passage 17.

Next, the oil pump 20 of this embodiment will be described. Before the description of the oil pump 20 of this embodiment, the structure of a conventional oil pump 120 will be described with reference to FIG. 11 and FIG. 12. FIG. 11 is a longitudinal sectional view showing the structure of the conventional oil pump 120. In the oil pump 120, a pump shaft 22 reciprocates axially while rotating in the internal space of a cylindrical pump case 121 having one closed end so as to make one stroke of reciprocation per rotation. The closed one end of the pump case 121 serves as a pump chamber 121*b*, to which the suction passage 17 communicating with the oil tank 14 and the discharge passage 18 corresponding to the oil discharge side are connected.

The suction passage 17 and the discharge passage 18 are formed as an integrated component, and their cylindrical parts are fitted to the end portion of the pump case 121. The pump shaft 22 disposed in the pump case 121 is rotated by a worm gear 23 screwed with the worm screw 16 attached to the drive shaft 13 of the engine, and is pushed axially by an elastic body 28 such as a spring. This pushing direction corresponds to the direction in which the pump shaft 22 is biased toward an open end of the pump case 121 opposite to the closed end thereof. An end portion of the pump shaft 22 on the open end side is prevented from coming off in an axial direction by using a fixing pin 24. At this time, since a sloped portion 22*a* is formed on an end face of the pump shaft 22, the pump shaft 22 reciprocates axially when the pump shaft 22 rotates in the state where the outer peripheral edge of the sloped portion 22*a* is abutting on the fixing pin 24.

In the pump chamber 121*b* of the pump case 121, a suction port 121*d* facing the suction passage 17 communicating with the oil tank 14 and a discharge port 121*e* facing the discharge passage 18 communicating with a component to which the oil is supplied are opened, and these suction and discharge ports are opened and closed by the outer peripheral surface of the rotating pump shaft 22. The outer peripheral surface of the pump shaft 22 near its front end is partly cut out to form a planar cutout portion 22*c*. The cutout portion 22*c* faces the suction port 121*d* or the discharge port 121*e* in conjunction with the rotation of the pump shaft 22 and creates a gap between the pump shaft 22 and the suction port 121*d* or the discharge port 121*e*, thereby opening or closing the suction port 121*d* or the discharge port 121*e*.

When the oil 15 is sucked in, the suction passage 17 communicates with the pump chamber 121*b*, and the discharge port 121*e* is closed by the outer peripheral part of the pump shaft 22 opposite to the cutout portion 22*c* across the axis of the pump shaft 22. Then, since the pump shaft 22 moves toward a gear chamber 121*a* by the rotation of the pump shaft 22 itself as indicated by an arrow in FIG. 11, the volume of the pump chamber 121*b* is expanded, and the oil can be effectively sucked into the pump chamber 121*b*. Also, when the oil is discharged from the pump chamber 121*b*, the pump shaft 22 rotates and moves toward the pump chamber 121*b* by the sloped portion 22*a* as indicated by an arrow in FIG. 12. As a result, the pump chamber 121*b* communicates the discharge passage 18, and the suction port 121*d* is closed. In this state, the volume of the pump chamber 121*b* is compressed, so that the oil flows through the discharge port 121*e* and is discharged from the discharge passage 18.

Figure 3:
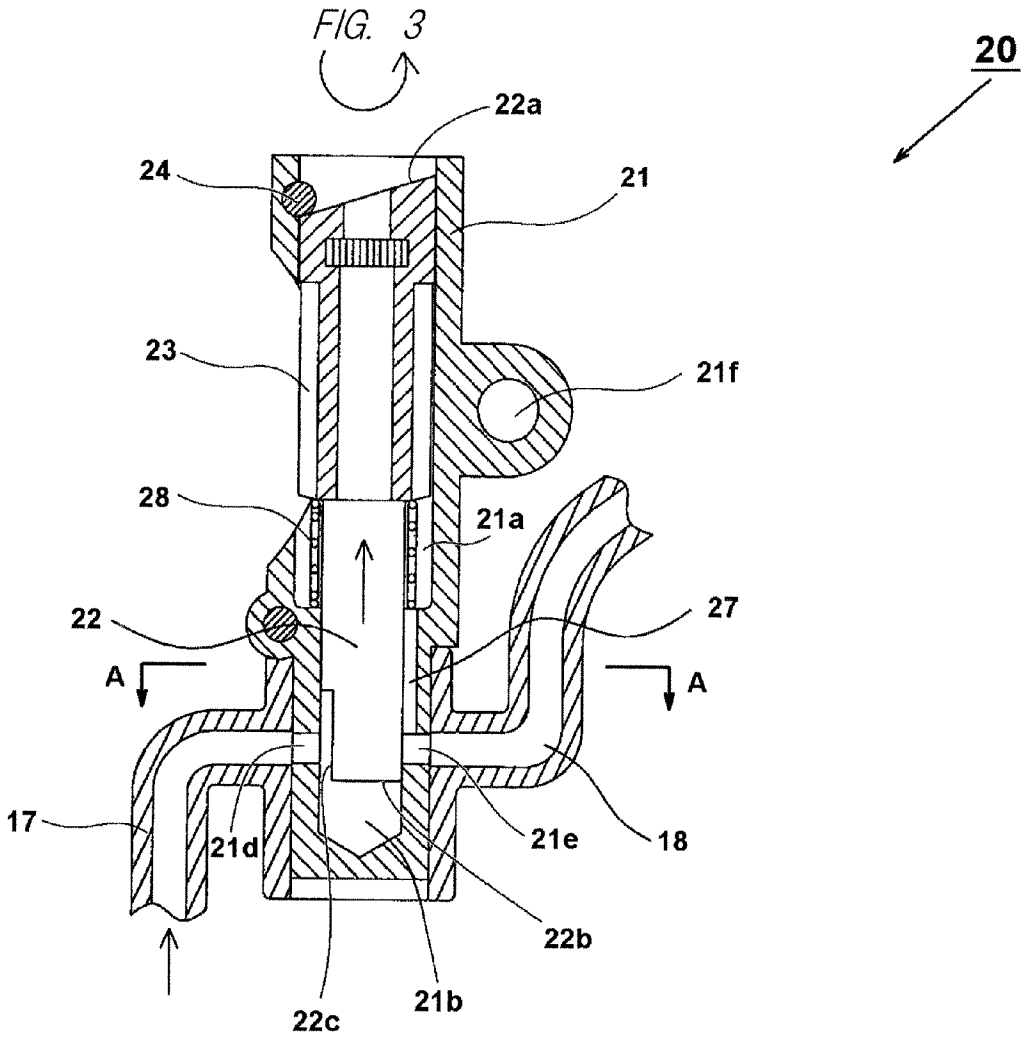
FIG. 3 is a longitudinal sectional view of the oil pump 20 of FIG. 2, showing the oil pump 20 in a suction state.
Figure 4:
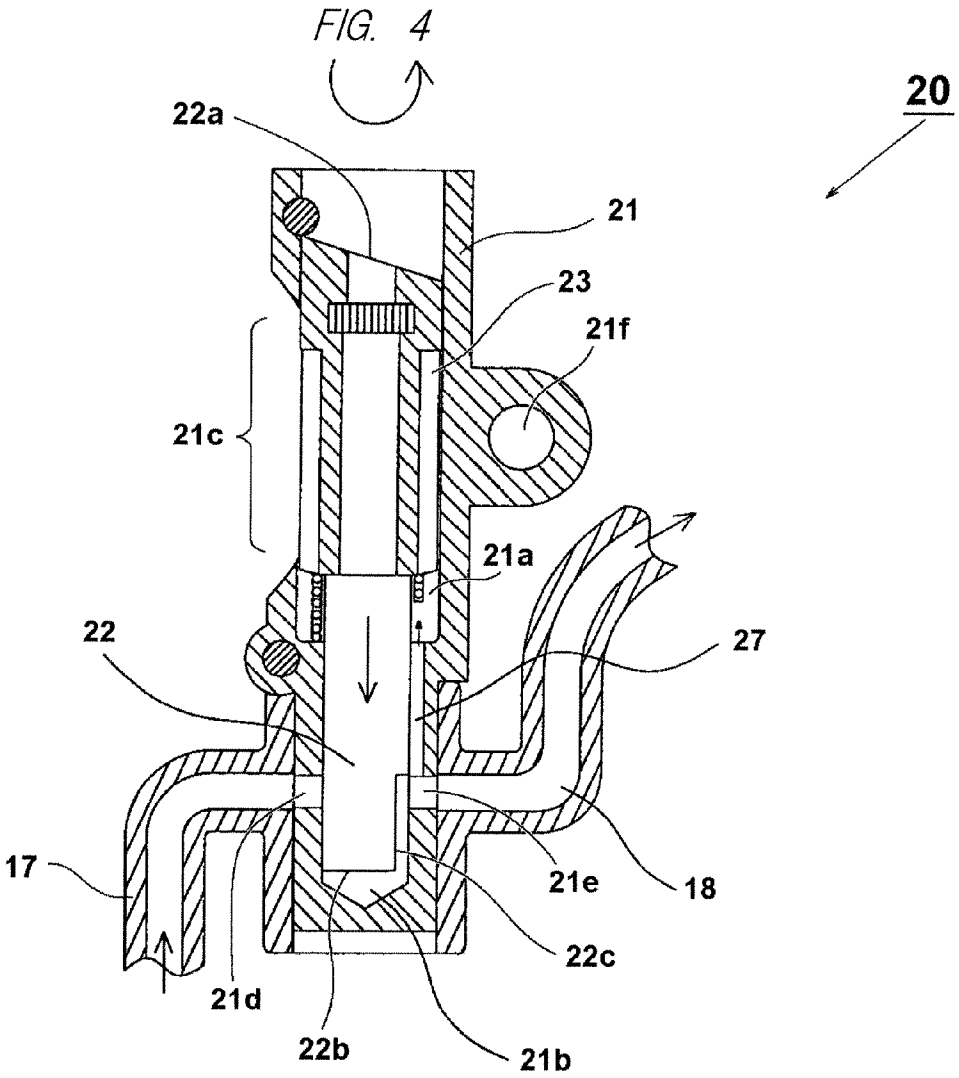
FIG. 4 is a longitudinal sectional view of the oil pump 20 of FIG. 2, showing the oil pump 20 in a discharge state.

Next, an example of the oil pump mechanism according to this embodiment will be described with reference to FIG. 3 to FIG. 6. In this embodiment, the same components as those in the conventional example are denoted by the same reference numerals. The oil pump 20 is fixed to the housing 2 with the screw 30 (see FIG. 2) put through a screw hole 21*f*. FIG. 3 is a longitudinal sectional view of the oil pump 20, showing the oil pump 20 in a suction state, and FIG. 4 is a longitudinal sectional view of the oil pump 20 in a discharge state. The oil pump 20 of this embodiment is different from the conventional oil pump in that an oil groove 27 which communicates a pump chamber 21*b* with a gear chamber 21*a* when the pump shaft 22 arrives at a predetermined rotation position is provided.

The gear chamber 21*a* mentioned here is a space isolated from the pump chamber 21*b* which is a closed space in the cylindrical pump case 21, and the elastic body 28 and the worm gear 23 are housed therein. In this embodiment, the gear chamber 21*a* is not completely sealed, but is an open space provided with an opening 21*c* (see FIG. 4) in which the worm screw is located. Usually, the pump chamber 21*b* and the gear chamber 21*a* are spatially isolated by the outer peripheral surface of the columnar pump shaft 22 and the inner peripheral surface of the cylindrical pump case, but these are connected by the oil groove 27 in this embodiment. The oil groove 27 is provided so as to be connected to the discharge port 21*e*. When the oil is sucked in, the pump chamber 21*b* and the discharge passage 18 are sealed up by a front end portion 22*b* of the pump shaft 22, so that the pump chamber 21*b* does not communicate with the discharge passage 18 via the oil groove 27.

FIG. 4 is a diagram showing the state where the pump shaft 22 has been rotated by 180 degrees from the state shown in FIG. 3. When the oil is discharged, the pump chamber 21*b* communicates with the discharge passage 18. Therefore, simultaneously with the discharge of the oil by the compression, a small amount of oil flows through the oil groove 27 to the gear chamber 21*a*. At this time, since the oil in the oil groove 27 comes in contact with the pump shaft 22 and adheres to the outer peripheral surface of the pump shaft 22 by the rotation thereof, the oil spreads into a gap between the pump case 21 and the pump shaft 22. As a result, the oil exerts its effect as a sealer to improve airtightness between the gear chamber 21*a* and the pump chamber 21*b* when the oil is sucked in.

The width and depth of the oil groove 27 should be very small. For example, it is preferable that the depth (length in a radial direction) of the oil groove 27 is set to 0.6 mm or less so that the oil just manages to get through the gap between the pump case 21 and the pump shaft 22 and an excessive amount of oil is not discharged out of the opening of the oil groove 27 close to the worm gear 23. In this structure, the gap between the pump case 21 and the pump shaft 22 can be effectively sealed by the oil, and both of the durability and the performance of the oil pump 20 can be improved.

Figure 5:
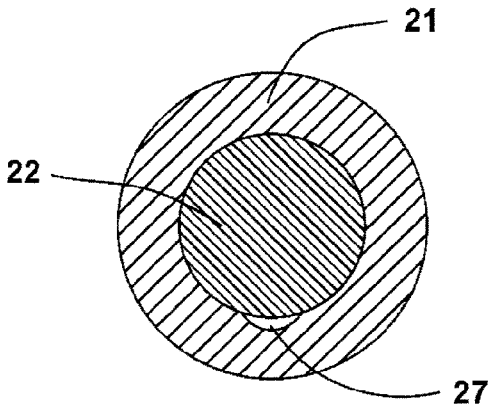
FIG. 5 is a transverse sectional view of the oil pump 20 taken along an A-A line of FIG. 3.

FIG. 5 is a transverse sectional view of the oil pump 20 taken along an A-A line of FIG. 3. The oil groove 27 is formed on a part of the inner peripheral surface of the pump case 21 so as to extend in parallel with the axial direction of the pump shaft 22. The oil groove 27 is preferably formed at a location in contact with the pump shaft 22, and the depth (length in a radial direction) and the width (length in a circumferential direction) of the oil groove 27 may be optimally determined depending on how much oil is supplied from the pump chamber 21*b* to the gear chamber 21*a*.

In the sectional view of FIG. 5, the oil groove 27 is depicted to have a little large size for making the present invention easily understood. However, what is aimed at in the embodiment is to supply the oil between the pump case 21 and the pump shaft 22 to seal the gap rather than to flow the oil from the gear chamber 21*a* to the pump shaft 22. Therefore, it is not always necessary that the actual oil groove 27 has the size shown in FIG. 5, and the oil groove 27 may be smaller in its width and depth.

Figure 6:
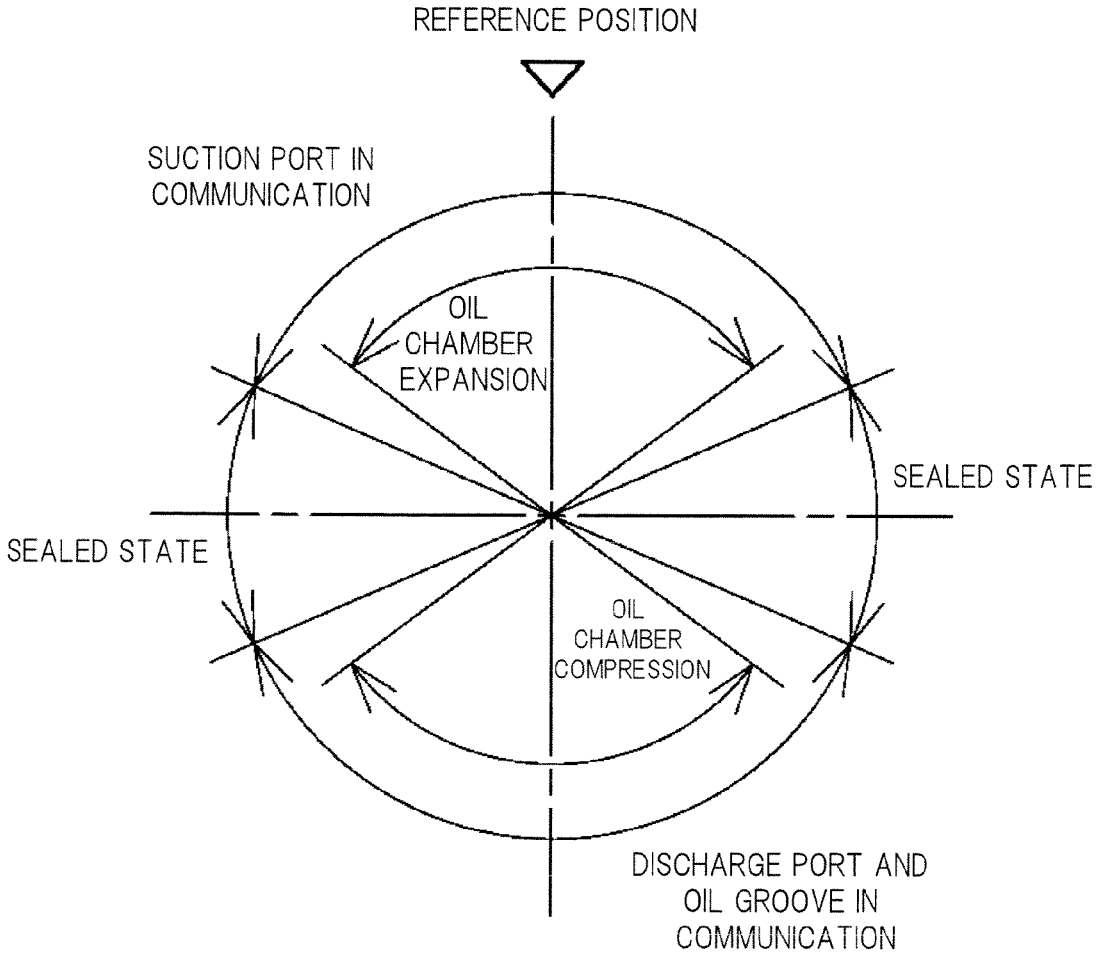
FIG. 6 is a diagram showing the opening/closing timing of each passage of the oil pump 20 of FIG. 3.

FIG. 6 is a diagram showing the opening/closing timing of each passage of the oil pump 20. FIG. 6 shows the state of the suction port 21*d* of the suction passage 17, the state of the discharge port 21*e* of the discharge passage 18, and the state of the pump chamber 21*b* (state of expansion or compression) in the period when the pump shaft 22 rotates by 360 degrees from its reference position, that is, the position of the pump shaft 22 shown in FIG. 3. The suction port 21*d* of the oil pump 20 is in a communicating state in a range of ±66 degrees with respect to the reference position (position at which a normal to the cutout portion 22*c* of the pump shaft 22 coincides with the axis of the suction passage 17).

The reason why the communicating state continues in such a wide range of about 132 degrees is that a part of the outer peripheral surface of the pump shaft 22 is planarly cut out and a predetermined space is present in front of the suction port 21*d*. On the other hand, in a range of the rotation angle from 114 degree to 246 degree, the discharge port 21*e* communicates with the pump chamber 21*b*. When the rotation angle of the pump shaft 22 is in a range from 66 degree to 114 degree and from 246 degree to 294 degree, the pump chamber 21*b* does not communicate with any port and is in a sealed state.

In this state, the pump chamber 21*b* is in an expansion state when the rotation angle is in a range from 307 degree to 53 degree, and it is in a compression state when the rotation angle is in a range from 127 degree to 233 degree. In the structure of this embodiment, when the discharge port 21*e* communicates with the pump chamber 21*b*, the oil groove 27 also communicates with the pump chamber 21*b*. This is because the oil groove 27 is formed so as to branch from the discharge port 21*e*.

Figure 7:
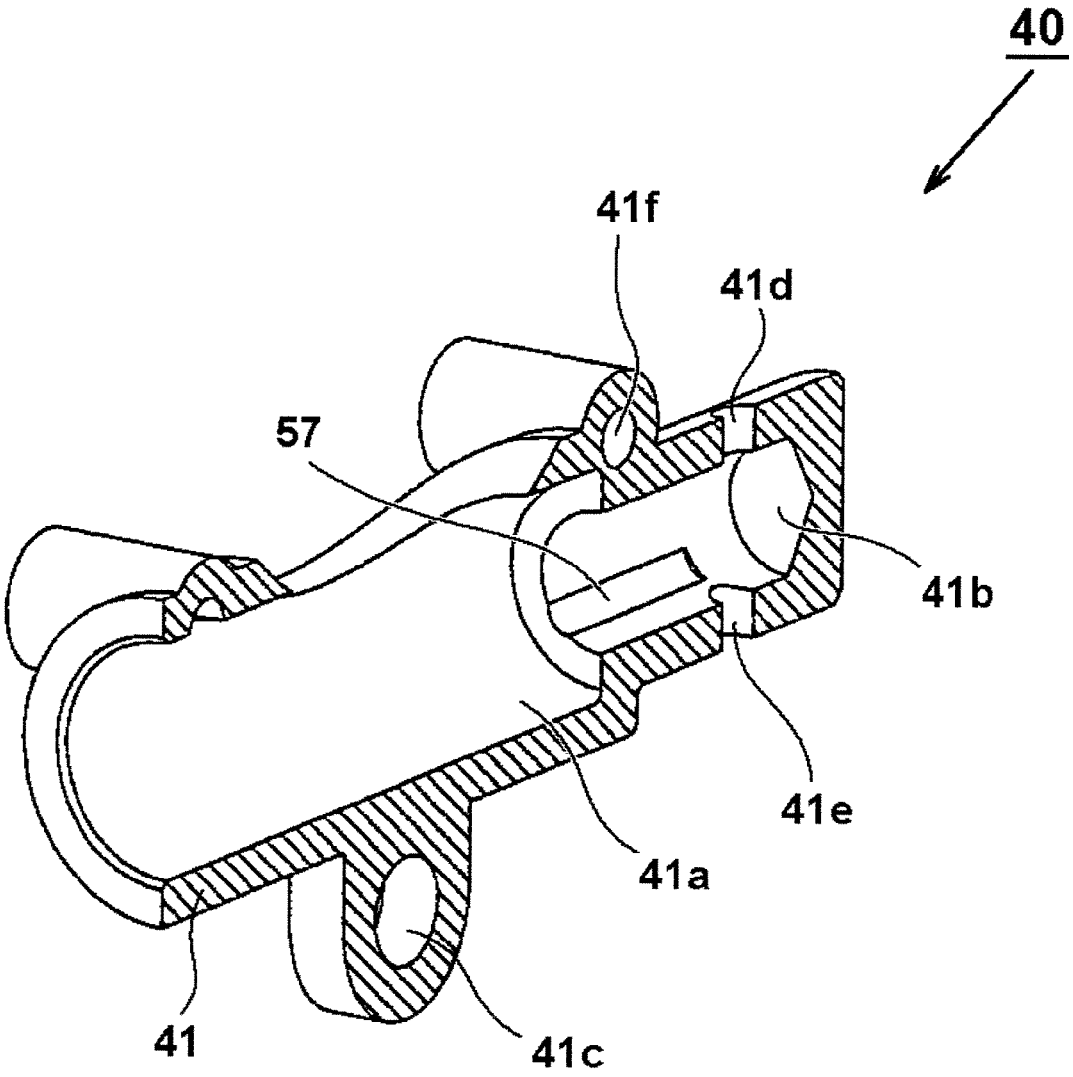
FIG. 7 is an exploded perspective view showing a groove shape of an oil pump 40 according to a second embodiment.

With this structure, only a small portion of the oil discharged from the pump chamber 21*b* to the discharge port 21*e* is delivered toward the gear chamber 21*a*. By forming the oil groove 27 on the inner peripheral surface of the pump case 21 to supply the oil toward the gear chamber 21*a* in the above-described manner, a proper amount of oil can be kept remaining between the pump shaft 22 and the pump case 21, and it is possible to maintain good airtightness. Note that, by forming the oil groove 27 at a location shifted in the circumferential direction to place the oil groove 27 at a location independent of the discharge port 21*e*, the timing at which the oil groove of FIG. 6 communicates can be shifted and the period in which the oil groove communicates can be changed. FIG. 7 shows a second embodiment in which the location of the oil groove is shifted.

Second Embodiment

FIG. 7 is an exploded perspective view showing a groove shape of an oil pump 40 according to the second embodiment of the present invention. The second embodiment is different from the first embodiment in the location of an oil groove 57, in particular, the location in the circumferential direction (the circumferential direction mentioned here is defined based on the direction of rotation of the pump shaft). In the first embodiment, the oil groove 27 is formed at the same location as the discharge port 21*e* in terms of the circumferential direction, and is connected to the discharge port 21*e*. On the other hand, in the second embodiment, the oil groove is shifted in the circumferential direction, and is formed as an independent groove, which does not interfere with the discharge port 41*e*, at a location where the oil groove 57 is not connected to the discharge port 41*e*. Also in the case where the oil groove 57 is formed at this location, the oil groove 57 communicates a pump chamber 41*b* with a gear chamber 41*a* only at the time when oil is discharged. When the oil groove 57 is provided at the location defined in the second embodiment, since the oil groove 57 can be formed so as to be misaligned with a dividing plane of a pump case 41 (the plane passing through the centers of the suction port 41*d* and the discharge port 41*e*), the oil leakage from the oil groove 57 can be prevented.

Third Embodiment

Figure 8:
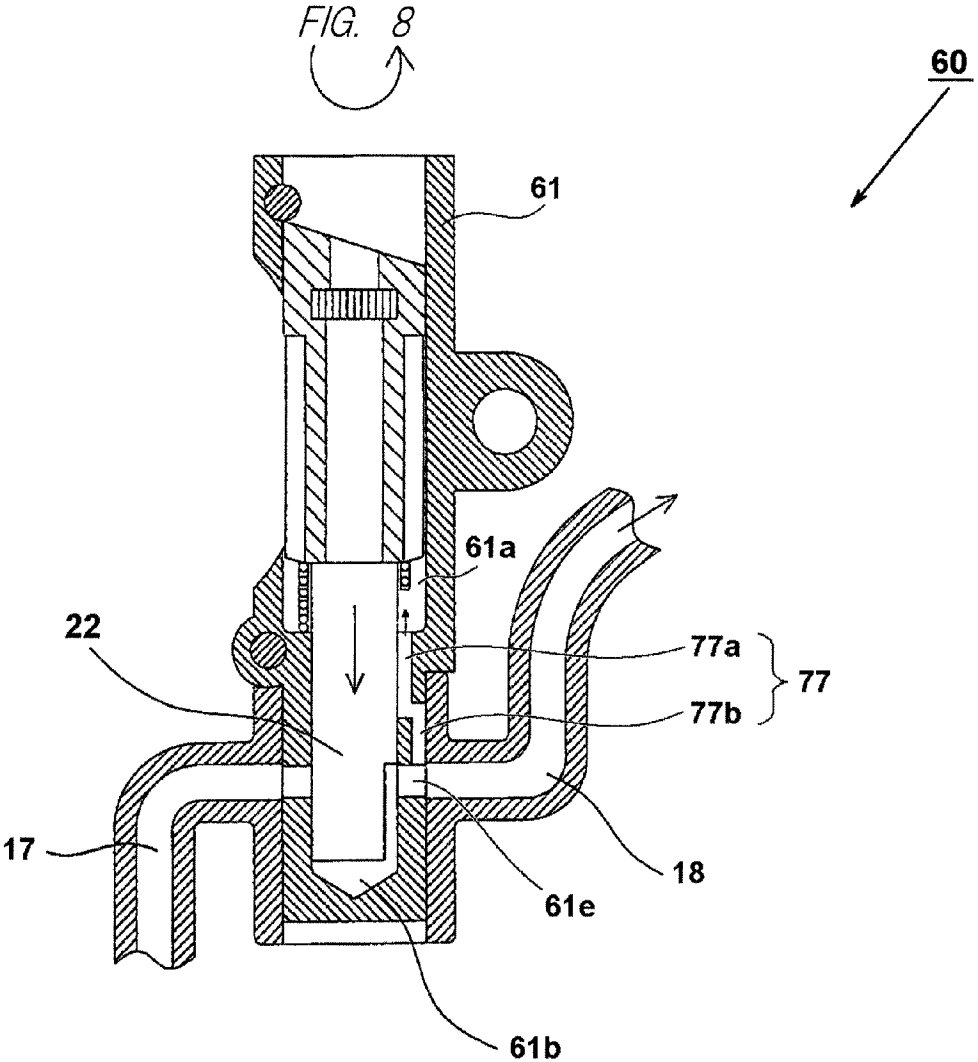
FIG. 8 is a longitudinal sectional view showing an oil pump 60 according to a third embodiment.

FIG. 8 is a longitudinal sectional view showing an oil pump 60 according to a third embodiment. The third embodiment is similar to the first embodiment in that an oil groove 77 is connected to a discharge port 61*e*. In the third embodiment, however, the oil groove 77 is formed as an outer peripheral groove 77*b* near a discharge port 61*e* so as to pass through an outer peripheral surface of a pump case 61 and also as an inner peripheral groove 77*a* near a gear chamber 61*a* so as to pass through an inner peripheral surface of the pump case 61. The outer peripheral groove 77*b* is connected to the inner peripheral groove 77*a* near the midpoint between the pump chamber 61*b* and the gear chamber 61*a*. An upper part of the inner peripheral groove 77*a* is open to the gear chamber 61*a*. By forming the oil groove 77 in this manner, the inner wall near a small arrow continuous in the circumferential direction serves as a sealing portion, so that the pump shaft 22 can rotate more smoothly. Therefore, it is possible to realize an oil pump with high rigidity and durability. Furthermore, since the upper part of the oil groove 77 is in contact with the outer peripheral surface of the pump shaft 22, the oil supplied to the oil groove 77 is effectively applied onto the outer peripheral surface of the pump shaft 22, and the sealability can be effectively improved.

Fourth Embodiment

Figure 9:
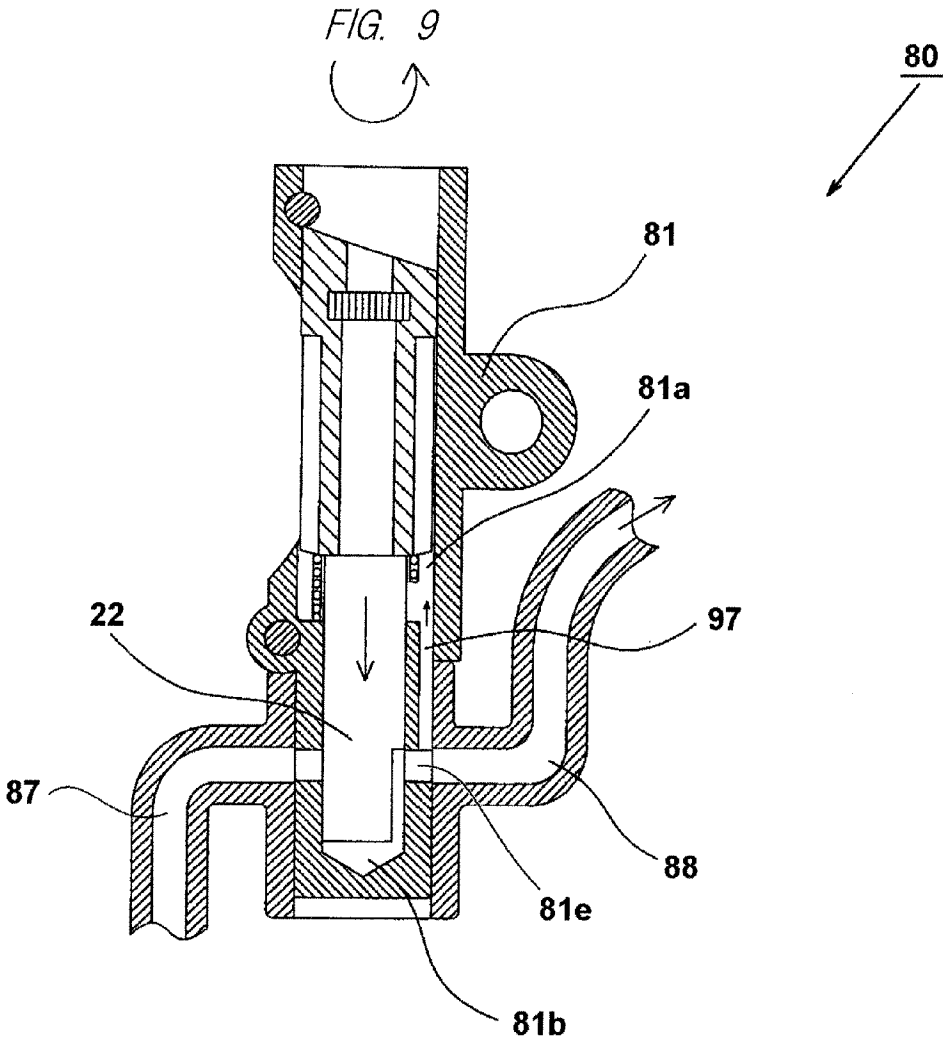
FIG. 9 is a longitudinal sectional view showing an oil pump 80 according to a fourth embodiment.

FIG. 9 is a longitudinal sectional view showing an oil pump 80 according to a fourth embodiment. In the fourth embodiment, an oil groove 97 is formed so as to pass through the outer periphery of a pump case 81 near a discharge port 81*e*, and is connected to a gear chamber 81*a*. In this manner, a pump chamber 81*b* directly communicates with the gear chamber 81*a* to supply the oil directly to a mouth of the pump case 81 (which is a stepped portion near a small arrow indicated in FIG. 9).

Fifth Embodiment

Figure 10:
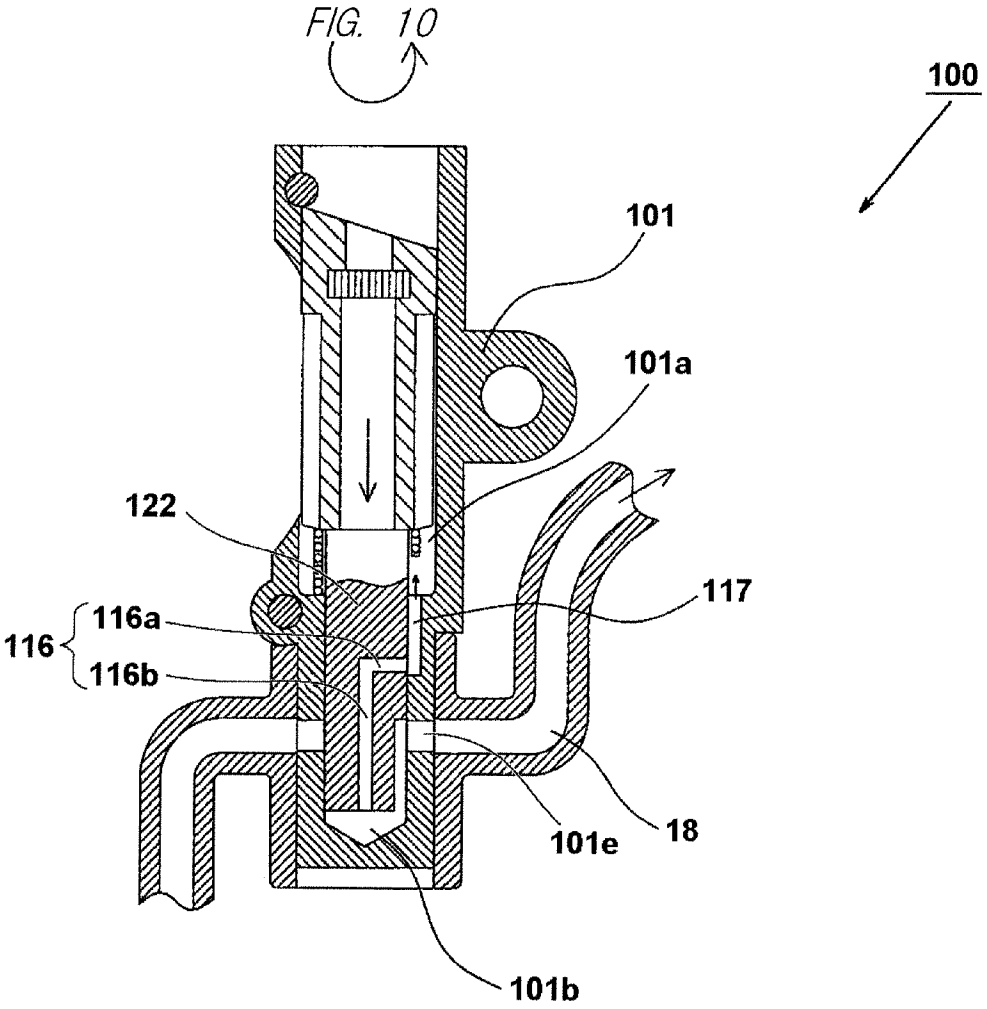
FIG. 10 is a longitudinal sectional view showing an oil pump 100 according to a fifth embodiment.

FIG. 10 is a longitudinal sectional view showing an oil pump 100 according to a fifth embodiment. In the fifth embodiment, an oil hole 116 which passes through the interior of a pump shaft 112 is formed. The oil hole 116 is composed of an axial groove 116*b* passing through the center of the pump shaft and a radial groove 116*a* extending in a radial direction from the axial groove 116*b*. The radial groove 116*a* has an opening at one portion, and when the opening matches an oil groove 117 formed in an axial direction along the inner wall of a pump case 101, oil flows from a pump chamber 101*b* and is supplied through the oil hole 116 and the oil groove 117 to a gear chamber 101*a*. In this manner, the oil hole 116 and the oil groove 117 are disposed so that the pump chamber 101*b* communicates with the gear chamber 101*a* only at a predetermined rotation angle in the oil discharge.

The present invention has been described based on the five embodiments. In each embodiment, it is possible to effectively prevent the phenomenon in which "as the period of use becomes longer, oil applied during an assembling process disappears to lose airtightness and invite the degradation in pumping performance". In particular, according to the present invention, since the oil hole and/or the oil groove through which a part of oil is supplied from the pump chamber to the gear chamber is formed, it is possible to keep the oil remaining on a portion of the pump shaft between the pump gear and the pump case. Therefore, it is possible to maintain the sealability of oil between the pump shaft and the pump case. As a result, the pump can operate steadily without the degradation in the performance of the pump even in a long period of use.

In the foregoing, the present invention has been described based on the embodiments. However, the present invention is not limited to the foregoing embodiments and various modifications and alterations can be made within the scope of the present invention. For example, in the descriptions of the embodiments above, an engine-driven chain saw is taken as an example of a portable working machine which carries out the work while supplying oil to a movable member of a working tool. However, the present invention can be applied also to an oil pump of any working machines other than the chain saw.

What is claimed is:

1. A portable working machine comprising:

an oil pump which supplies oil from an oil tank to a movable member of a working tool by a rotation motion of a drive shaft of a power source, wherein:

the oil pump includes:

a pump case having a pump chamber whose one end is closed and to which a suction passage and a discharge passage are connected and a gear chamber in which a gear which converts rotation motion of the drive shaft is housed; and a pump shaft which is housed in the pump case, is connected to the gear, and has a tip end rotating in the pump chamber, an oil groove, which communicably connects the pump chamber and the gear chamber when the pump shaft arrives at a predetermined rotation position, is formed in the pump case, the oil groove is formed at a location at which the oil groove is closed to the pump chamber together with the discharge passage and the oil groove does not communicably connect the pump chamber and the gear chamber when the oil is sucked through the suction passage to the pump chamber, and the oil groove is opened to the pump chamber together with the discharge passage and communicably connects the pump chamber and the gear chamber when the oil is discharged from the pump chamber to the discharge passage, when the oil is discharged from the pump chamber, a part of the oil flows from the pump chamber to the gear chamber through the oil groove, and the oil groove communicating with the gear chamber communicates with the pump chamber via a discharge port.

2. The portable working machine according to claim 1, wherein the oil groove is formed at a location in contact with the pump shaft, and a suction passage, a discharge passage, and the oil groove are opened and closed by the rotation of the pump shaft.

3. The portable working machine according to claim 1, wherein, in the pump case, the oil groove is formed in an inner wall in contact with the pump shaft.

4. The portable working machine according to claim 1, wherein the pump shaft swings axially while rotating so that the tip end of the pump shaft compresses or expands the pump chamber, and the oil groove is formed in parallel with an axial direction of the pump shaft.

5. The portable working machine according to claim 1, wherein the oil groove is formed of a through-hole formed in a wall of the pump case.

6. The portable working machine according to claim 1, wherein the oil groove is made by forming a cutout or a groove in the pump shaft.

7. The portable working machine according to claim 1, wherein the oil groove is formed of a through-hole extending from a tip end surface of the pump shaft, passing through an interior thereof, and reaching a side surface of the pump shaft.

* * * * *